US011412780B2

(12) United States Patent
Russell

(10) Patent No.: US 11,412,780 B2
(45) Date of Patent: Aug. 16, 2022

(54) TOBACCO CAN HOLDER

(71) Applicant: Morgan Russell, Lynchburg, VA (US)

(72) Inventor: Morgan Russell, Lynchburg, VA (US)

( * ) Notice: Subject to any disclaimer, the term of this patent is extended or adjusted under 35 U.S.C. 154(b) by 0 days.

(21) Appl. No.: 17/174,740

(22) Filed: Feb. 12, 2021

(65) Prior Publication Data

US 2021/0244090 A1 Aug. 12, 2021

Related U.S. Application Data

(60) Provisional application No. 62/975,245, filed on Feb. 12, 2020.

(51) Int. Cl.
*A24F 23/00* (2006.01)

(52) U.S. Cl.
CPC ..... *A24F 23/00* (2013.01)

(58) Field of Classification Search
CPC ..... A24F 23/00
USPC ..... 206/38, 236, 237, 238, 239, 242, 248, 206/264; 131/329
See application file for complete search history.

(56) References Cited

U.S. PATENT DOCUMENTS 2,021,436 A * 11/1935 Charles ..... A24F 9/12 131/243
2,582,183 A * 1/1952 Weidler ..... A47G 19/06 229/406
2,821,101 A * 1/1958 Hendricks ..... B65D 85/305 81/3.09
4,335,814 A * 6/1982 Benning ..... B65D 71/0003 206/198
4,733,807 A * 3/1988 Porter ..... B65D 25/22 206/37
4,944,423 A * 7/1990 Clark ..... A47G 19/30 206/238
5,054,638 A * 10/1991 Rose ..... A47G 23/0266 220/759
5,165,579 A * 11/1992 Lund ..... B65D 51/243 220/258.2
5,752,599 A * 5/1998 Veltman ..... B60R 7/00 131/260
6,651,836 B1 * 11/2003 Hofheins ..... A47G 19/06 206/562
8,469,187 B2 6/2013 Wattenbarger et al.
8,573,437 B1 * 11/2013 Evans ..... A47J 47/16 220/737

(Continued)

*Primary Examiner* — Jacob K Ackun
(74) *Attorney, Agent, or Firm* — Boudwin Intellectual Property; Daniel Boudwin

(57) ABSTRACT

A holder for a tobacco container is provided. The device includes a body having a base, a sidewall extending upwardly therefrom, and a top side defining an interior volume. The base includes a recession that frictionally secures a container of chewing tobacco therein. In one embodiment, the sidewall diameter tapers inwardly from an upper end to a lower end thereof, such that a funnel is formed. A clip is attached to the holder that can secure the holder to a keychain or other similar object. An opening tool will be embedded in the top side of the tobacco container holder's body. In one embodiment of the tobacco container holder, the opening tool will further comprise a sharpened edge that can puncture the wrapper on a tobacco container. The sidewall catches chewing tobacco that may be accidentally dropped when retrieving chewing tobacco from its container, thereby reducing waste.

5 Claims, 3 Drawing Sheets

(56) References Cited

U.S. PATENT DOCUMENTS

Figure 1:
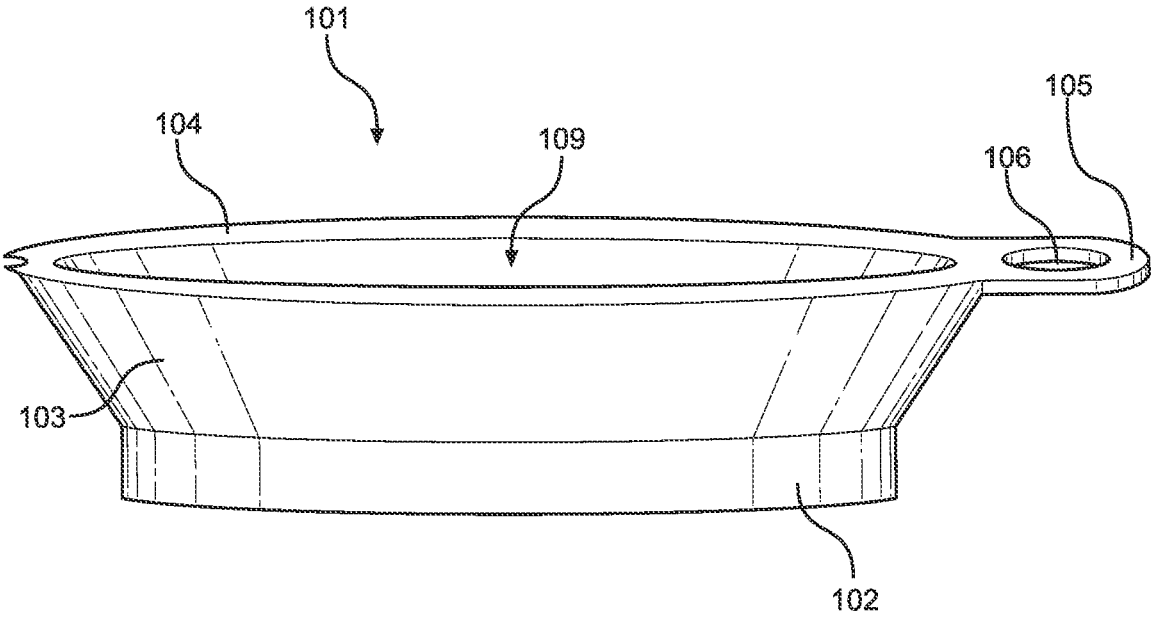

| | | | | |
|---|---|---|---|---|
| D756,841 | S | 5/2016 | Torrez | |
| 9,724,273 | B2 | 8/2017 | Brown | |
| 9,999,575 | B2 | 6/2018 | Lampe et al. | |
| 2002/0175195 | A1* | 11/2002 | Cole | A24F 23/02 224/269 |
| 2004/0168996 | A1 | 9/2004 | Jones | |
| 2006/0065668 | A1* | 3/2006 | Whitaker | B44D 3/123 220/737 |
| 2008/0098853 | A1* | 5/2008 | Choate | B67B 7/16 81/3.09 |
| 2008/0202535 | A1* | 8/2008 | Stokes | F23Q 2/32 131/249 |
| 2009/0159471 | A1* | 6/2009 | Koppe | A45F 5/021 206/242 |
| 2011/0107878 | A1* | 5/2011 | Gust | B67B 7/16 81/3.15 |
| 2012/0228175 | A1* | 9/2012 | Ressel | A47G 23/0216 206/457 |

* cited by examiner

TOBACCO CAN HOLDER

CROSS REFERENCE TO RELATED APPLICATIONS

This application claims the benefit of U.S. Provisional Application No. 62/975,245 filed on Feb. 12, 2020. The above identified patent application is herein incorporated by reference in its entirety to provide continuity of disclosure.

BACKGROUND OF THE INVENTION

The present invention relates to a container holder. More specifically, the present invention provides a tobacco container holder that has a sidewall that prevents tobacco from dropping on to undesirable surfaces when a user is removing tobacco from a tobacco container.

Tobacco users have numerous methods of consumption. The methods to consume tobacco can be smokeless or via smoking. Among the methods of smokeless tobacco, users can chew the tobacco leaves or place a pack of tobacco between their lips and gums. Although the different methods of smokeless tobacco can be packaged in various types of containers, the common forms of packaging are either a pouch or a can. The most common type of chew tobacco comes in the form of loose-leaf tobacco. For loose-leaf tobacco, the tobacco leaves are shredded. The users can place the shredded leaves into their mouth and chew on the shredded leaves or place a pack of shredded leaves between their gums and lip. These methods allow the user to taste the tobacco flavor and absorb the nicotine.

With the pouch or the can, the users will insert their fingers therein to extract the desired amount of the loose-leaf tobacco they that they want to insert into their mouth. However, due to the shredded nature of the tobacco, it can be difficult to remove the tobacco from the container without a fragment of the shredded tobacco leaves falling out of the container or out of the users fingers when they are transferring it to their mouth. When the tobacco gets dropped on undesired surfaces, the tobacco can cause issues to the surface or to another person.

When tobacco falls onto undesired surfaces it can cause issues to the surface and the health of others. Certain types of the shredded tobacco can stain different objects. If when retrieving tobacco from a container the tobacco falls onto a white or light colored carpet, the carpet can become stained and it will be difficult for the individual that is cleaning it up to remove the stain that the tobacco fragment leaves behind. Moreover, some of the fragments that can fall out of the container, or the hand of the user when they transport the tobacco to their mouth, can be too small to see and ultimately clean up. This can leave small fragments of tobacco on the ground. If the user is in a house or another building with a small child or a pet, the small child or pet can find the tobacco fragment and place it into their mouth. If the small child or pet were to place a fragment of tobacco into their mouth, there is a chance that they swallow the fragment of tobacco. Swallowing the tobacco can lead to the small child or pet to become sick and require appropriate medical attention.

Additionally, users store the smokeless tobacco containers in their pocket or in a bag, such as a backpack or purse. Compared to the other types of tobacco containers, the can tobacco containers are rigid and protrude from the pocket of the user. When the user has the container in their pocket it can be uncomfortable for the individual to sit down. Also, when the user places the tobacco container into a bag there is the possibility that the lid of the tobacco container detaches from the rest of the tobacco container. When the lid of the tobacco container comes off while the tobacco container is in a bag, the contents of the tobacco container can spill within the bag. This could cause the bag to be damaged. The smokeless tobacco loose in the interior of a bag can both stain and leave an odor that will be difficult for an individual to remove.

Therefore, there is a defined need amongst the known prior art references for a holder for a tobacco container that properly prevents small fragments of tobacco falling onto undesirable surfaces and provides an alternative carrying method for users.

SUMMARY OF THE INVENTION

In view of the foregoing disadvantages inherent in the known types of tobacco container holders now present in the known art, the present invention provides a new tobacco container holder wherein a sidewall is tapered inwardly from an upper end to a lower end thereof, such that a funnel is formed, as well as a clip for attachment to an object.

It is therefore an object of the present invention to provide a tobacco container holder that prevents fragments of tobacco to fall onto undesired surfaces. The tobacco container holder comprises a body that includes a base, a sidewall, and a top side. Together the base, the sidewall, and the top side end define an interior volume where the tobacco container will be place. The sidewall comprises an upper end and a lower end, wherein the lower end is affixed to the base. Additionally, the sidewall tapers inwardly from the upper end to the lower end. The tobacco container will engage with the base to secure it to the tobacco container holder. Moreover, when the tobacco container is empty, the user can disengage the tobacco container from the base in order to discard it and replace it with a new tobacco container. When the tobacco container is secure to the tobacco container holder, the sidewall will extend upwardly from the base to provide a surface that will catch the fragments of tobacco that fall out of the container or the users fingers when they extract tobacco from the tobacco container during consumption. The sidewall will prevent those fragments of tobacco from falling onto undesired surfaces. Thus, limiting the chance that the fallen pieces of tobacco can stain carpets and future or provide a safety hazard for small children or pets.

Another aspect of the present invention is to allow a user to selectively attach the tobacco container holder to the user's person or a keychain or other similar object. A member will extend horizontally from the top side of the tobacco container holder's body. An aperture is disposed through the member. The aperture will be able to engage a clip, such that the aperture will encircle the clip. Then the clip can secure the tobacco container holder to the desired person or object.

Yet another aspect of the present invention is to allow users to open the tobacco container by removing the wrapper. An opening tool will be embedded in the top side of the tobacco container holder's body. In this embodiment of the tobacco container holder, the opening tool will further comprise a sharpened edge that can puncture the wrapper on a tobacco container. The user will engage the opening tool with the wrapper just underneath the lid of the tobacco container. Once the opening tool punctures the wrapper along the entire circumference of the tobacco container, the user will be able to remove the lid of the tobacco container and access the contents therein. This aspect of the tobacco container holder provides the users with the ability to easily puncture the wrapper that seals the tobacco container.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

FIG. 1 shows a side view of an embodiment of the tobacco container holder.

Figure 2A:
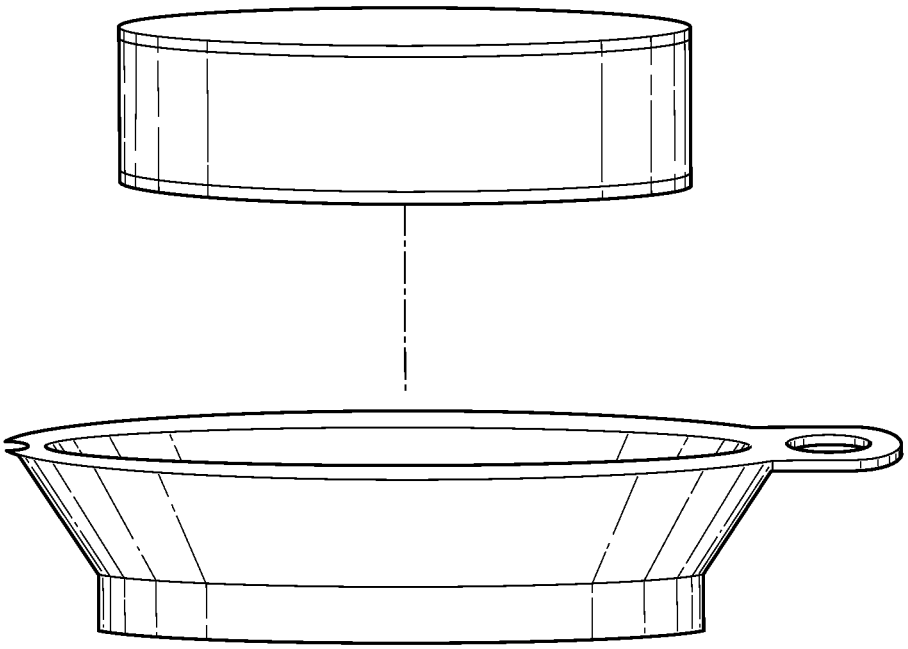

FIG. 2*a* shows a side view of an embodiment of a tobacco container inserted into the tobacco container holder.

Figure 2B:
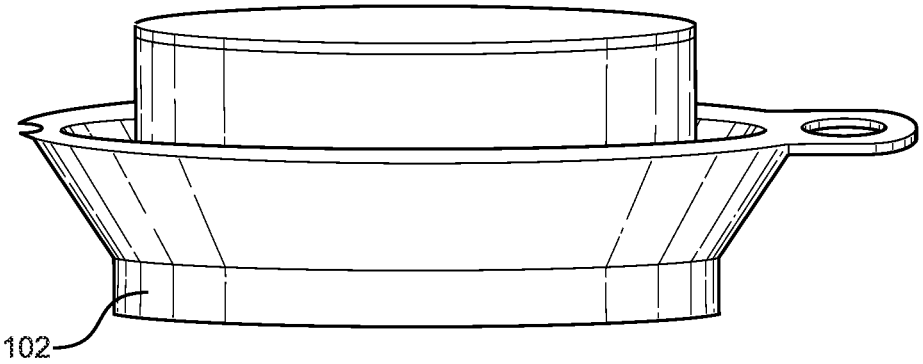

FIG. 2*b* shows a side view of an embodiment of a tobacco container inserted into the tobacco container holder.

Figure 3:
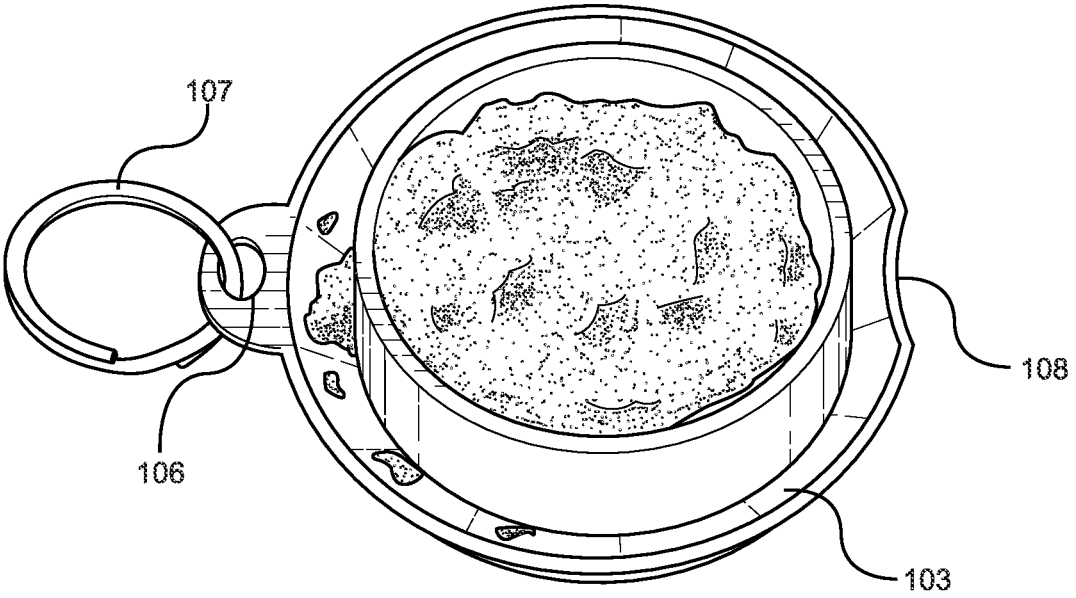

FIG. 3 shows a top view of an embodiment of the tobacco container holder in use.

DETAILED DESCRIPTION OF THE INVENTION

Reference is made herein to the attached drawings. Like reference numerals are used throughout the drawings to depict like or similar elements of a tobacco container holder. The figures are intended for representative purposes only and should not be limiting in any respect.

FIG. 1 shows a side view of an embodiment of the tobacco container holder. The tobacco container holder comprises a body 101, wherein the body 101 further comprises a base 102, a sidewall 103, and a top side 104. The base 102 is rounded in shape to support similarly shaped containers, but other shapes can be utilized. The base 102 includes an interior face, an exterior face, and a surrounding edge. The sidewall 103 is affixed to the surrounding edge of the base 102. The top side 104 of the base 102 is disposed on the top of the sidewall 103. The interior face of base 102, the sidewall 103, and the top side 104 form an interior volume 109.

A member 105 is disposed on the top side 104 of the body 101. The member 105 projects outward and horizontally from the top side 104. In one embodiment, the member 105 is circular in shape. The member 105 has an upper face and a lower face. An aperture 106 is disposed through the upper face and the lower face of the member 105. The aperture 106 can encircle a clip 107 to connect to a person or a keychain or other similar object.

FIG. 2*a* and FIG. 2*b* show side views of an embodiment of a tobacco container inserted into the tobacco container holder. The tobacco container will be inserted into the body 101 of the tobacco container holder. The base 102 will encircle the bottom of the tobacco container and include a recession that frictionally secures the tobacco container to the tobacco container holder. The recession assures that, when the tobacco container holder is attached to a person or a bag, the movement of the tobacco container holder will not dislodge the tobacco container from the base 102.

In the embodiment of the tobacco container holder shown, the sidewall 103 tapers inwardly from the top side 104 to a lower end affixed to the base 102 thereof, such that a funnel is formed. In an alternative embodiment of the tobacco container holder, the sidewall 103 further comprises a lip disposed parallel with the base 102. A diameter of the lip is larger than a diameter of the tobacco container. When the tobacco container is received by the recession on the base 102, the lip extends beyond the tobacco container thereby providing a larger surface area to catch the fragments of tobacco that may fall out of the tobacco container or the hand of the user removing the tobacco from the tobacco container.

When the tobacco container is engaged with the base 102 of the tobacco container holder, the top side 104 will be below the top of the tobacco container. Such that the user will be able to remove the lid of the tobacco container to access the contents of the tobacco container. While the tobacco container is secured in the base 102 of the tobacco container holder, the sidewall 103 will expand outwardly from the exterior of the tobacco container. Moreover, when the tobacco container is empty, the user can disengage the tobacco container from the base 102 of the tobacco container holder.

FIG. 3 shows a top view of an embodiment of the tobacco container holder in use. The sidewall 103 and the top side 104 of the body 101 further comprises an opening tool 108. The opening tool 108 is embedded in sidewall 103. In the embodiment of the tobacco container holder shown, the opening tool 108 comprises a sharpened edge that is concave in relation to the upper end of the sidewall 103. In another embodiment of the tobacco container holder, the opening tool 108 is protracted from the top side 104. In another embodiment of the tobacco container holder, the opening tool 108 comprises a plurality of teeth along the top side 104. The opening tool is used to puncture a wrapper under the lid of the tobacco container that preserves the freshness of the contents. In use, the user will puncture the wrapper that seals the tobacco container in order to remove the lid to access the contents of the tobacco container.

In use, when the tobacco container is engaged with the base 102 of the tobacco container holder, the user will be able to remove the lid of the tobacco container and access the contents of the tobacco container. When the user extracts the contents from of the tobacco container, the sidewall 103 and the top side 104 are configured to catch any fragments of the tobacco container's contents that may fall over of the edge of the tobacco container or out of the user's fingers. If a loose fragment of the tobacco container's contents land on the sidewall 103 and the top side 104 of the body 101, the user can easily transport the fragments back into the tobacco container or discard of the fragments of tobacco. Moreover, the fragments the tobacco that do fall will not land on an undesired surface.

Additionally, a user can attach the tobacco container holder to their person or a bag via a clip 107. The clip 107 will be inserted though the aperture 106 disposed on the member 105. Such that the aperture 106 disposed on the member 105 encircles a clip 107. When the clip 107 secured to the tobacco container holder, the user can connect the clip 107 to their person or a keychain or other similar object. When the tobacco container holder is connected to a person or other object, the user will engage the lid of the tobacco container upon the tobacco container to prevent the contents of the tobacco container from falling out.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention

The invention claimed is:

1. A holder, comprising:

a body;

wherein the body further comprise a base, a sidewall, and a top side defining an interior volume;

the base includes an interior face, an exterior face, and a surrounding edge;

the sidewall tapers towards the base, whereby the sidewall extends upwardly from the interior face of the base and outwardly from the surrounding edge of the base;

the sidewall comprises an upper end and a lower end, wherein the lower end is affixed to the base;

wherein the top side encircles the upper end of the sidewall;

wherein the upper end of the sidewall has a diameter larger than a diameter of the lower end of the sidewall;

a member extended horizontally from the top side;

an aperture disposed on the member;

an opening tool disposed on the top side; and whereby the member and the opening tool are on opposing ends of the top side.

2. The holder of claim 1, wherein the base is rounded in shape; whereby the interior face of the base and the sidewall secure a container in the interior volume.

3. The holder of claim 1, wherein the aperture disposed on the member secures a clip thereon.

4. The holder of claim 1, wherein the aperture disposed on the member secures a key ring thereon.

5. The holder of claim 1, wherein the member is circular in shape.

* * * * *